US008274223B2

(12) United States Patent
Hirao et al.

(10) Patent No.: US 8,274,223 B2
(45) Date of Patent: Sep. 25, 2012

(54) HIGH PRESSURE DISCHARGE LAMP WITH AN ELECTRODE HAVING ALTERATING OFFSET PARALLEL GROOVES

(75) Inventors: Tetsuji Hirao, Hyogo (JP); Hirohisa Iwabayashi, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/801,935

(22) Filed: Jul. 2, 2010

(65) Prior Publication Data

US 2011/0025203 A1 Feb. 3, 2011

(30) Foreign Application Priority Data

Jul. 31, 2009 (JP) ..... 2009-178933

(51) Int. Cl.

| | |
|---|---|
| ***H01J 11/00*** | (2012.01) |
| ***H01J 17/00*** | (2006.01) |
| ***H01J 17/18*** | (2012.01) |
| ***H01J 17/04*** | (2006.01) |

(52) U.S. Cl. ..... 313/623; 313/567; 313/631

(58) Field of Classification Search ..... None
See application file for complete search history.

(56) References Cited

U.S. PATENT DOCUMENTS

| | | | | |
|---|---|---|---|---|
| 5,142,195 | A * | 8/1992 | Heider et al. | 313/623 |
| 6,683,413 | B2 * | 1/2004 | Okubo et al. | 313/574 |
| 6,891,332 | B1 | 5/2005 | Irisawa et al. | |
| 7,671,536 | B2 * | 3/2010 | Takagaki et al. | 313/631 |
| 7,759,872 | B2 * | 7/2010 | Hosoya et al. | 313/631 |
| 7,800,307 | B2 * | 9/2010 | Tsukamoto et al. | 313/631 |
| 2008/0185950 | A1 | 8/2008 | Claus et al. | |
| 2008/0315771 | A1 | 12/2008 | Tsukamoto et al. | |
| 2011/0043110 | A1 * | 2/2011 | Tsukamoto et al. | 313/631 |

FOREIGN PATENT DOCUMENTS

| | | |
|---|---|---|
| JP | 2001-006617 A | 1/2001 |
| JP | 2008-529252 A | 7/2008 |
| JP | 2008-282554 A | 11/2008 |

OTHER PUBLICATIONS

Japanese Office Action for corresponding Japanese Application No. 2009-178933.

* cited by examiner

*Primary Examiner* — Natalie Walford
(74) *Attorney, Agent, or Firm* — Rader, Fishman & Grauer PLLC

(57) ABSTRACT

The present invention relates to a high pressure discharge lamp that includes a pair of electrodes, which face each other in an electric discharge space. Further, an electrode axis of one of the electrodes is joined to a metallic foil in a sealing portion, and two or more grooves are formed in an axis direction on a portion corresponding to the sealing portion on the electrode axis. Furthermore, a remaining portion that lacks grooves is left on the electrode axis in a metallic foil side thereof, and the metallic foil side ends of the grooves are not aligned with each other in the axis direction thereof.

2 Claims, 3 Drawing Sheets

HIGH PRESSURE DISCHARGE LAMP WITH AN ELECTRODE HAVING ALTERATING OFFSET PARALLEL GROOVES

CROSS-REFERENCES TO RELATED APPLICATION

This application claims priority from Japanese Patent Application Serial No. 2009-178933 filed Jul. 31, 2009, the contents of which are incorporated herein by reference in their entirety.

TECHNICAL FIELD

The present invention relates to a high pressure discharge lamp, and specifically relates to a high pressure discharge lamp used for a light source of a projector apparatus and a light source of an exposure apparatus.

BACKGROUND

In such a high pressure discharge lamp, the so-called foil seal structure, in which a base portion of an electrode axis is joined to a metallic foil buried in a sealing portion, is adopted as a sealing structure. In general, because the electrode axis of the electrode is made of tungsten while an arc tube is made of silica glass the sealing portion of the arc tube often breaks and/or is damaged due to difference in the thermal expansion coefficients. Especially, since a large amount of mercury (i.e. 0.15 mg/mm$^3$ or more) is enclosed in a light emitting portion of such a high pressure discharge lamp used for a projector apparatus so that the mercury steam pressure turns into high pressure (i.e. 100 or more atmospheric pressure) at time of lighting, the above problem is much more serious.

Japanese Patent Application Publication No. 2008-529252 teaches technology in which grooves are formed on an axis of an electrode (core rod) to extend along in an axis direction thereof, in order to solve such a problem. FIG. 3A is a schematic view of the structure of a lamp according to a conventional example, and FIG. 3B is an enlarged view of an electrode. As shown in FIGS. 3A and 3B, two or more grooves 5, which extend in an axis direction of an electrode 2, are formed on an outer surface area of an electrode axis 21 provided in a discharge lamp 1, which faces a sealing portion 3 of the arc tube. In addition, the electrode axis 21 is connected to a metallic foil 4 inside the sealing portion 3. In the above-mentioned conventional technology, the surface coarseness in a circumference direction is made larger than that of a longitudinal direction thereof since two or more grooves 5 are formed on the electrode axis 21, thereby preventing breakage of the sealing portion due to the difference in the thermal expansion coefficient of the material (tungsten) of the electrode axis 21 and the material (silica glass) of the sealing portion 3.

SUMMARY

However, in the conventional technology, the two or more grooves 5, which continuously extend in a direction of the electrode axis 21, are formed so that ends of the grooves are arranged in the same position in the axis direction. Thus, stress tends to be concentrated on the portion where the ends of the grooves 5 are arranged in the same position in the axis direction. Therefore, since the stress due to thermal expansion and contraction caused by temperature change at the time of lighting and lighting-out is generated at the ends of the grooves 5 on the electrode axis 5, there is a problem that the portion serves as a starting point for generating fractures. Specifically, since the end of the electrode axis 21 in the side of the metallic foil 4 are intensively heated at time of sealing work so as to be brought in close contact with silica glass, the end thereof also serve as an acting point of vibration of the electrode 2 at time of lighting. Therefore, since stress concentrates there, the problem is bigger when the ends in the metallic foil side of the grooves 5 are positioned at the same position in the electrode axis direction. Especially when the diameter of the electrode axis 21 is small, as in high pressure discharge lamps and for example at a level of 0.1-1.0 mm, a strength reduction may occur causing bending or breakage of the electrode axis, thereby posing a more serious problem.

In view of the above problems of the prior art, the present invention relates to damage and breakage of a sealing portion due to difference in the thermal expansion coefficient of the electrode axis and silica glass. In a high pressure discharge lamp according to the present invention, two or more grooves are formed on an axis of an electrode in an axis direction and no grooves are formed on a remaining portion in a metallic foil side of the electrode axis, which solves the problem of the electrode axis tending to bend and fracture due to stress concentration.

More specifically, in the high pressure discharge lamp according to the present invention, to avoid stress concentration the two or more grooves are formed on the electrode axis thereof, and the ends of the two or more grooves in the metallic foil side thereof are not aligned with each other in the electrode axis direction.

Thus, according to the present invention, since the ends of grooves in the metallic foil side, which are formed on the electrode axis, are not aligned with each other in the electrode axis direction, the stress concentration near the groove ends of the electrode axis is avoided, so that the electrode axis is not bent or damaged at the portion which serves as a starting point.

BRIEF DESCRIPTION OF DRAWINGS

Other features and advantages of the present high pressure discharge lamp will be apparent from the ensuing description, taken in conjunction with the accompanying drawings, in which.

DESCRIPTION

Figure 1A:
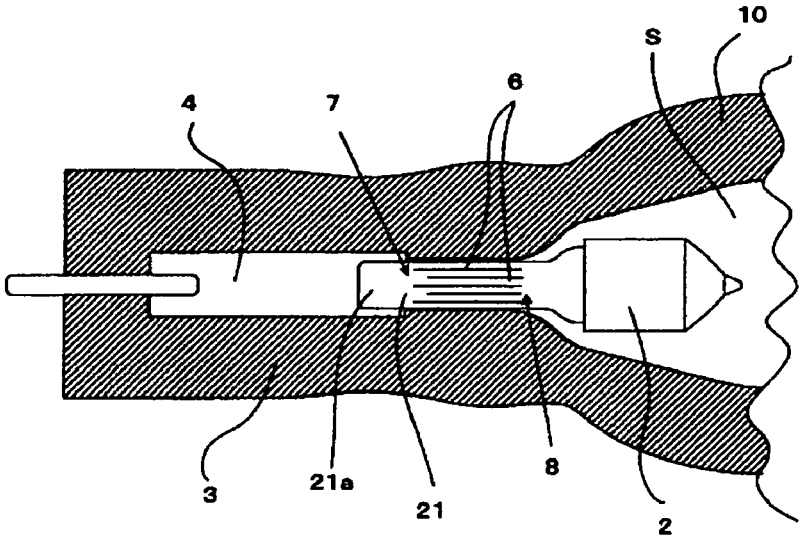
FIG. 1A is a partial sectional view of a high pressure discharge lamp according to the present invention.
Figure 1B:
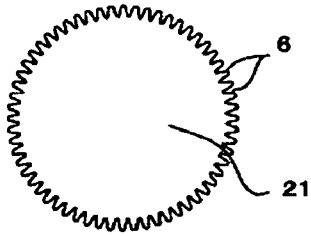
FIG. 1B is a sectional view of an electrode axis.

FIG. 1A is a partial sectional view of a high pressure discharge lamp according to the present invention, and FIG. 1B is a sectional view of an electrode axis thereof. In FIG. 1A, only one electrode 2 and a sealing portion 3 are shown, and the other side thereof is omitted. In the figure, an electric discharge space S is formed in a light emitting portion 10, which is made of silica glass, and the electrodes 2 are arranged in the space S, so as to face each other. The sealing portion 3 is formed at each end of the light emitting portion 10, and a metallic foil 4 for electric conduction, which is made of molybdenum, is airtightly buried in the sealing portion 3 by, for example, shrink sealing. An electrode axis 21 of the electrode 2 is joined to an end of the metallic foil 4 by, for example, welding. The electric discharge space S of the light emitting portion 10 is filled up with appropriate electric discharge gas. For example, an ultrahigh pressure discharge lamp for a projector apparatus encloses mercury, rare gas, and halogen gas. The mercury enclosed therein is, for example, 0.08-0.25 mg/mm$^3$, and the amount thereof differs depending on the temperature condition. The steam pressure increases (i.e. 80 atmospheric pressure or more) at time of lighting. Moreover, the electrode 2 is arranged so as to face each other at intervals of 1-2 mm.

As shown in FIG. 1B, two or more grooves 6 are formed on a circumference face of the electrode axis 21 of the electrode 2. As shown in FIG. 1A, the grooves 6 are formed so as to extend in an axis direction, leaving a remaining portion 21*a* on a metallic foil 4 side of the electrode axis 21 lacking grooves, and the groove ends 7 in the side of the metallic foil 4 are not aligned with one another in the axis direction. In this example, the groove ends 8 in the side of the electric discharge space S are approximately aligned, but the groove ends 7 in the side of the metallic foil are not aligned with one another by changing the length of each of grooves 6.

Figure 2A:
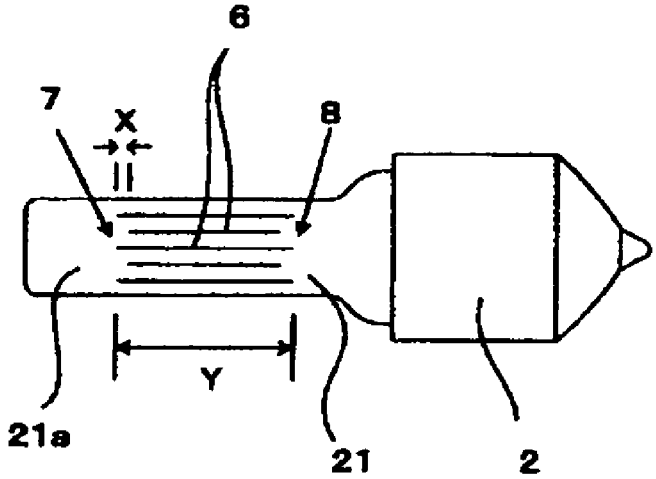
FIGS. 2A and 2B show other embodiments according to the present invention, in which grooves differ from that shown in FIGS. 1A and 1B.
Figure 2B:
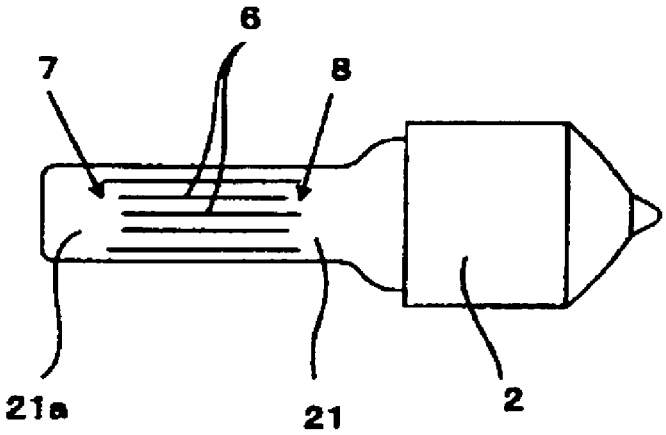
Figure 3A:
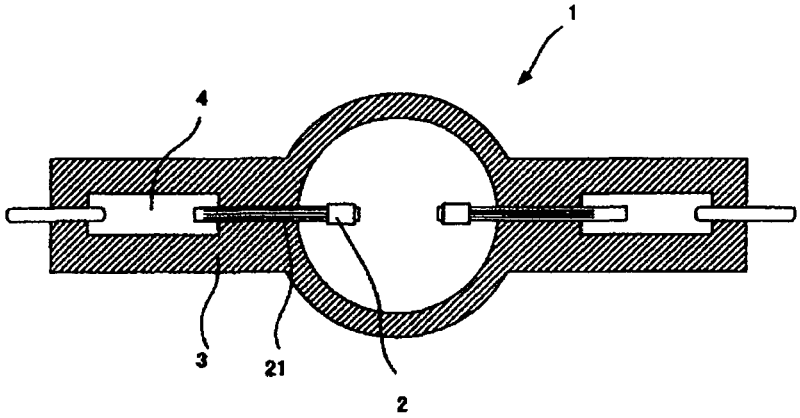
FIG. 3A is a cross sectional view of a conventional high pressure discharge lamp.
Figure 3B:
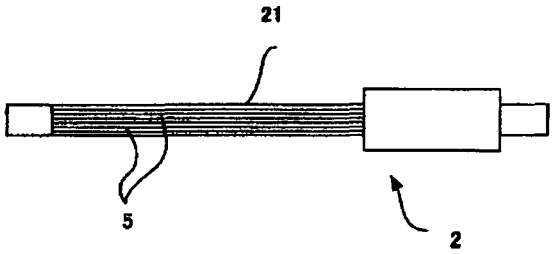
FIG. 3B is a side view of an electrode of a conventional high pressure discharge lamp.

FIGS. 2A and 2B show other examples in which grooves 6 differ from those shown in FIGS. 1A and 1B. FIG. 2A shows an example where ends 7 and 8 are not aligned, so that in this example, a long groove and a short groove are alternatively arranged. Moreover, in FIG. 2B, the grooves having several lengths are at random arranged so as to extend in the axis direction, so that the grooves at the both sides are not aligned.

In addition, in the above-mentioned embodiment, although a remaining portion 21*a*, in which no groove 6 is formed, is left on the metallic foil side of the electrode axis 21, the electrode axis 21 and the metallic foil 4 are joined using this remaining portion 21*a* (i.e. by welding).

The grooves are not aligned in the ends 7 in the metallic foil side thereof so that the stress concentration is eased. The smaller the number of the grooves 6 whose ends are aligned is, the more effects are expected. The number of the grooves whose ends are aligned is preferably set to 50% of the total number of grooves. Moreover, if the lengths in the axis direction of the grooves 6 are too short, the effects of reducing a contact area which is in contact with silica glass cannot be expected. Therefore, in the ends in the metallic foil side of the electric axis 21, a distance (X shown in FIG. 2A) between an end of one groove and an end of another groove whose end forming position is different from that of the one groove, is preferably set to 10% or less of the length (Y shown in FIG. 2A) in the axis direction of the entire area where the grooves are formed.

The grooves 6 are formed optimally by laser processing. Specifically, the grooves 6 are formed by focusing a YAG laser beam with a wavelength of 1.06 μm (micrometers) and 3 kW output, so as to form a beam with a diameter of approximately 20-30 μm, in order to irradiate and scan a surface of the electrode axis 21. The laser is a pulsed laser and the depth of the grooves can be adjusted by adjusting a pulse interval, intensity, a scanning rate, etc. Moreover, in addition to the laser processing, desired grooves can be formed by electric spark machining. In this case, grooves can be formed by setting the diameter of the electric discharge electrode to a desired size so as to scan with it in the axis direction.

As mentioned above, in the high pressure discharge lamp according to the present invention, since the ends of the two or more grooves in the metallic foil side, which are formed on the electrode axis in the axis direction, are not aligned with one another in the axis direction, stress concentration at that portion can be avoided, which prevents bending and/or breakage of the electrode axis. Furthermore, since the remaining portion, where no groove is formed, is left on the electrode axis, it is possible to easily and certainly weld the metallic foil and the electrode axis together using the remaining portion by welding.

The preceding description has been presented only to illustrate and describe exemplary embodiments of the present high pressure discharge lamp. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope.

What is claimed is:

1. A high pressure discharge lamp comprising:

a pair of electrodes that face each other in an electric discharge space, wherein each one of the pair of electrodes includes an electrode body extending along and about an electrode body axis and having an electrode end portion, a smooth end portion and a grooved intermediate portion integrally connected to and disposed between the electrode end portion and the smooth end portion and wherein each one of the pair of electrodes includes a first series of axially-extending grooves and a second series of axially-extending grooves formed into and disposed circumferentially about the grooved intermediate portion such that at least one end of each one of the first series of grooves terminates at an end of the grooved intermediate portion and at least one end of each one of the second series of grooves terminates prior to the end of the grooved intermediate portion, each respective one of the first series of the axially-extending grooves is disposed between and extends parallel to consecutive respective ones of the second series of the axially-extending grooves and each respective one of the second axially-extending grooves is disposed between and extends parallel to consecutive respective ones of the first series of the axially-extending grooves.

2. The high pressure discharge lamp according to claim 1, further comprising a pair of metallic foils, wherein respective ones of the metallic foils join respective ones of the smooth end portions.

* * * * *